United States Patent [19]

Mechulam et al.

[11] 4,004,494

[45] Jan. 25, 1977

[54] MILITARY OBSERVATION POST

[75] Inventors: André Mechulam, Tarbes; Bruno M. Saintours-Payerne, St Etienne; Guillaume A. Gay-Chatain, St Etienne; Paul R. Montjallard, St Etienne, all of France

[73] Assignee: Etat Francais, Paris, France

[22] Filed: Mar. 6, 1974

[21] Appl. No.: 448,567

[52] U.S. Cl. ..... 89/36 L

[51] Int. Cl.[2] ..... F41H 5/22

[58] Field of Search ..... 89/36 R, 36 B, 36 C, 89/36 F, 36 G, 36 H, 36 Z, 36 J, 36 K, 36 L, 40 B

[56] References Cited

UNITED STATES PATENTS

| | | | |
|---|---|---|---|
| 1,327,339 | 1/1920 | Logan | 89/36 Z |
| 2,454,268 | 11/1948 | Brackett | 89/36 K |
| 3,757,635 | 9/1973 | Hickerson et al. | 89/36 H |

*Primary Examiner*—Stephen C. Bentley

[57] ABSTRACT

An observation post for military equipment such as a turret for an armored car comprising a structure having an opening through which at least the head of an observer can pass, and a sealable enclosure for the opening including an inner transparent cap fitted at the opening, and an outer armored hatch cover for covering the inner cap. The outer cover can be selectively opened and closed independently of the inner cap. The transparent cap may also be operable independently of the armored cover and advantageously the cap and the armored cover are respectively pivotable about a common axis. A closure latch can be carried by the armored cover for automatically locking the cover when it is closed, the closure latch being unlocked from within the observation post by manually operating a handle. A closure latch can also be carried by a frame of the cap for automatically locking the cap when it is closed, the latch being unlocked from within the observation post.

13 Claims, 12 Drawing Figures

FIG. 3
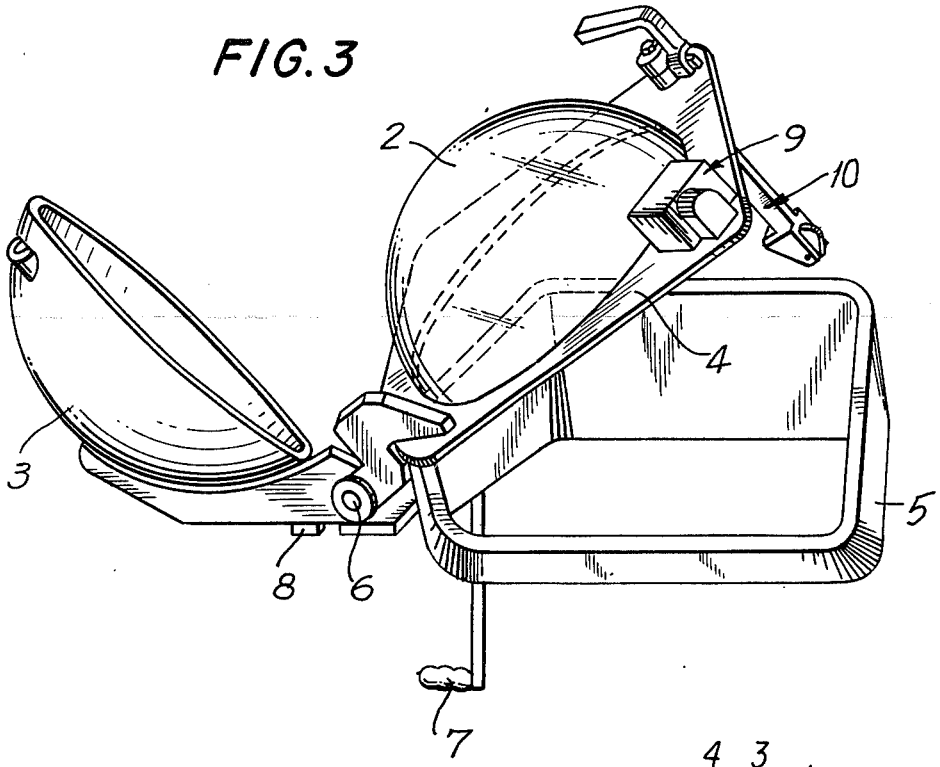
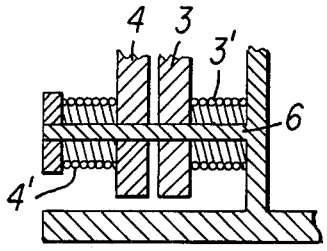
FIG. 4a
FIG. 4
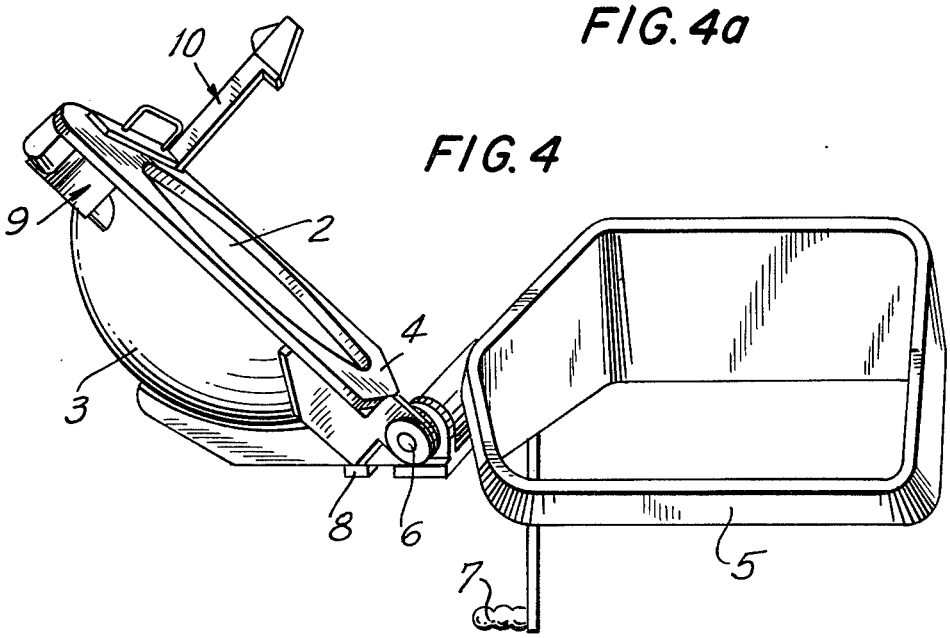

FIG. 5
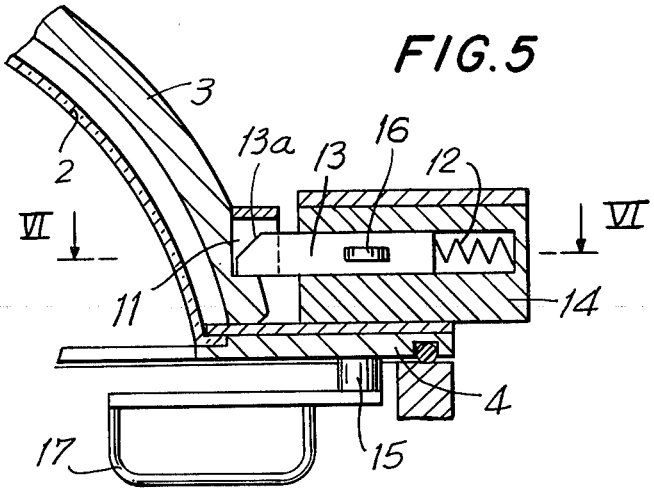
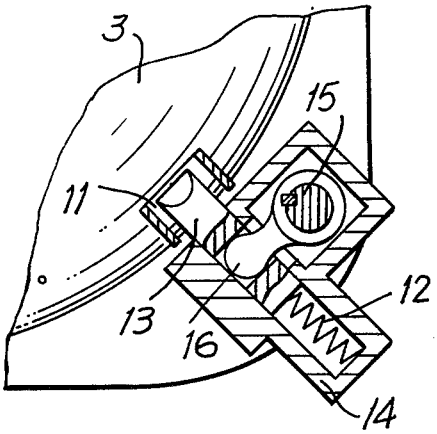
FIG. 6
FIG. 7
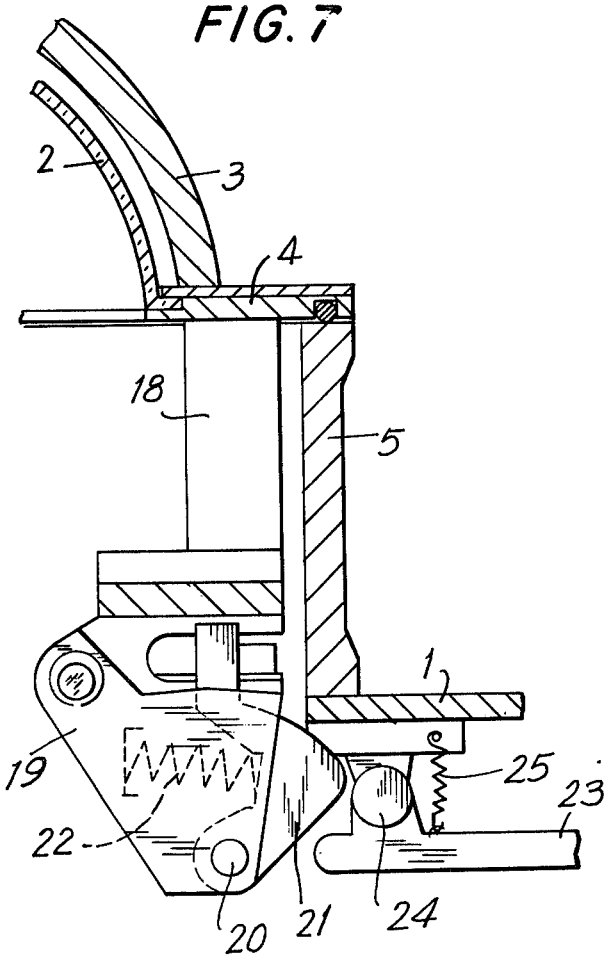

MILITARY OBSERVATION POST

BACKGROUND

The invention relates to military observation posts, this expression being used in a wide sense and including equipment of a fixed type such as, for example, on fortresses and observation blockhouses, as well as mobile equipment of the same type, such as ground vehicles, naval vessels and aerial military equipment.

It can also be noted that the military observation posts according to the invention can be simple observation posts or can be equipped with one or several guns.

It is suitable to note that in this domain of utilization which is relatively wide (fixed or mobile equipment, with or without guns), the invention is particularly applicable to armored cars, and notably, vehicles of this type equipped with an observation turret (even a simple bubble, i.e. a turret of a small diameter), said turret carrying generally, but not necessarily, at least one gun (notably a gun mounted on the roof of the turret) whose direction of aim is coupled to the rotation movement of the turret and whose angle of elevation is controlled by an operator occupying the observation post.

Armored cars of this type include tanks, combat vehicles, reconnaissance vehicles or personnel carriers (wheeled or tracked).

It is known that in the conditions of modern combat, military equipment and particularly land equipment runs the risk of being exposed to a harmful atmosphere from a nuclear, bacteriological, or chemical point of view, such atmosphere being described in military language as an N.B.C. atmosphere.

Of interest from the military point of view is the possibility of using such observation posts when these are placed in an N.B.C. atmosphere.

Additionally, being given that it behaves as military equipment, it is important that it behaves as military equipment, it is important to conserve the possibility of protection of the observation post by an armored cover thanks to which the operator can close the opening of the observation post in case of direct enemy attack and complete the observation mission by means of optical apparatus in the interior of the observation post.

SUMMARY OF INVENTION

An object of the invention is to provide military equipment having an observation post (notably armored vehicles with a turret generally equipped with at least one gun) which provides improved operational conditions in an N.B.C. atmosphere.

According to the invention, the military equipment with an observation post (notably vehicles and more particularly armored vehicles) has an opening allowing passage of at least the head of the observer, the equipment being characterized in that said opening is sealingly protected by a transparent cap, advantageously of plastic material, said transparent cap being itself covered externally by an armored cover which is positively openable by a control means situated in the interior of the observation post and permitting selective opening or closing of the armored cover without influence on the disposition of the transparent cap.

It is suitable to note that the term "cap" is intended to designate a curved cover having its convex side turned towards the exterior.

In this way, for the observation of a direct view in an N.B.C. atmosphere (or one which it is feared may become an N.B.C. atmosphere) it will suffice if the observer opens the armored cover to provide a direct view of the environment while being isolated from the ambient atmosphere and while retaining the capability of protecting himself by closing the armored cover in case of sudden and direct enemy attack (by automatic weapon fire, for example).

Although the invention contemplates fixedly mounting the transparent cap, it is preferable to mount the transparent cap in such fashion that it can be opened when the armored cover is already opened, whereby by opening the two (armored cover and transparent cap) communication can be established between the interior of the turret and the exterior atmosphere via the observation opening, for example, for purposes of ventilation or evacuation.

In this case, that is to say when the two covers are openable, they are mounted in such fashion that they are advantageously urged to open positions by means of respective recall means, the covers being pivotably mounted around a common axle disposed at the periphery of the aforesaid covers which therefore permits the two covers to cover their openings and to interfit into one another, the armored cover protecting the transparent cap.

The aforesaid common axle is advantageously oriented parallel or perpendicular to the median vertical plane of the observation opening, such that the opening of the caps is effected laterally or towards the rear, the armored cover being associated with an abutment limiting its degree of opening to a position inclined upwardly and outwardly. In this fashion, when the armored cover is opened, it provides lateral or rear protection for the observer even if the transparent cap is open. The armored cover is preferably equipped with a closure latch which is automatically engaged upon closing of the cover, the latch being opened by manually operating a control member from within the interior of the observation post. Preferably, a recall means acts on the armored cover to open the same when the closure latch is released, after which the operator can completely open the armored cover by acting on the positive control means of this cover.

With respect to the transparent cap it is also preferably equipped when it is openable, with a closure latch which is automatically engaged upon closing of the cap, the latch being opened by manually operating a control member from within the interior of the observation post. A recall means is provided to open the transparent cap when the closure latch is released, after which, the operator can completely open the transparent cap (the armored cover being assumed completely open) by manually pushing the same towards the exterior, the transparent cap being relatively lightweight (with respect to the armored cover) to facilitate its direct displacement.

When the two covers are articulated around a common axle, it is possible to advantageously secure the transparent cap on a frame articulated around said common axle and adapted to engage around the edge of the observation opening.

In this case, the closure latches of the armored cover and transparent cap, can advantageously have their operative elements carried by the aforesaid frame, the complementary elements of these two latches being carried in the case of the armored cover by the cover itself, and in the case of the armored cover by the cover itself, and in the case of the transparent cap, by the rim of the structure of the observation post.

These diverse dispositions offer to the operator numerous possibilities of operation corresponding to the following different operational conditions:

a. armored and transparent covers both closed, the armored cover being latched to the frame carrying the transparent cap, the frame in turn being latched to the structure of the observation post (alert condition);

b. proceeding from condition (a), simultaneous opening of the two covers by liberation of the latch of the transparent cap and operating the positive control means of the armored cover which entrains in its opening movement the frame carrying the transparent cap (safe condition from all points of view);

c. proceeding from condition (a), opening the armored cover only by releasing the closure latch of the armored cover and operating the positive control means, the frame carrying the transparent cap remaining locked in closed position (observation in N.B.C. atmosphere);

d. proceeding from condition (b), closing the transparent cap only (alert to an N.B.C. atmosphere) by releasing the closure latch of the armored cover and manually lowering the frame carrying the transparent cap, to automatically latch the frame in a closed position on the structure of the observation post;

e. proceeding from condition (b), simultaneously closing the two covers by actuating the positive control means of the armored cover, the locking in closed position resulting from automatic engagement of the closure latch of the transparent cap (alert condition to enemy fire);

f. proceeding from condition (d), closing the armored cover by its positive control means (safety condition from enemy fire from an observation in a state of alert for an N.B.C. atmosphere); and g. proceeding from condition (d), opening the transparent cap by releasing its closure latch and manually pushing it open.

BRIEF DESCRIPTION OF THE DRAWING

FIG. 3 shows the armored cover in open position and the transparent cap in an intermediate open position;

FIG. 4 shows both the armored cover and transparent cap in open positions;

FIG. 4*a* is a diagrammatic sectional view taken through the axle around which the armored cover and transparent cap pivot;

FIG. 5 is a sectional view on enlarged scale of a closure latch of the armored cover;

FIG. 6 is a sectional view taken on line VI—VI in FIG. 5;

FIG. 7 is a vertical sectional view of a lock for the transparent cap;

DETAILED DESCRIPTION

Figure 1:
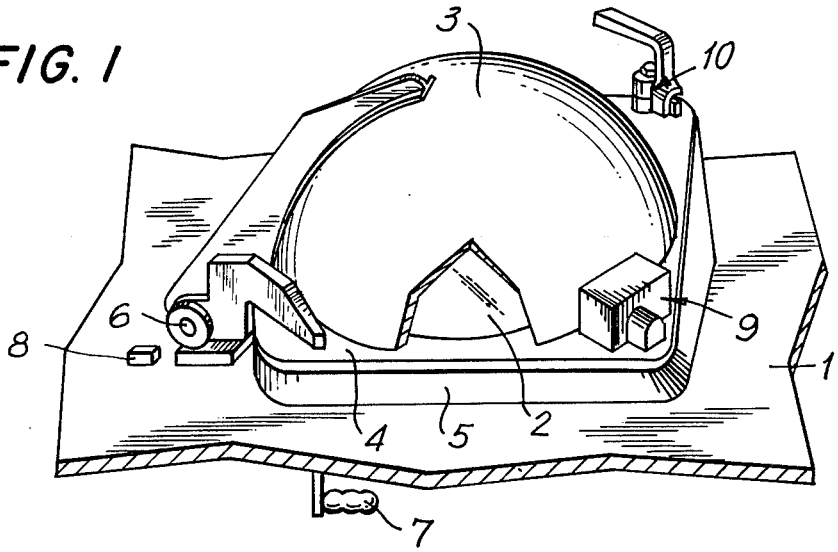
FIG. 1 is a perspective view, partly broken away and in section of the upper part of a turret of an armored vehicle in which both a transparent cap and an armored cover are in closed position.

Referring to FIG. 1, therein is seen a roof 1 of a turret of an armored vehicle, the roof 1 being provided with an observation opening allowing passage at least of the head of the operator. The opening is closed in air-tight fashion by a transparent cover or cap 2 of plastic material, the cap in turn being covered by an armored hatch cover 3 of corresponding shape. For example, the covers may be of hemispherical shape.

The transparent cap 2 is fixed to a frame 4 adapted for being seated on a rim 5 surrounding the observation opening. The armored cover 3 and the aforesaid frame 4 are articulated on a common axle 6 fixed to the roof 1 proximate the periphery of the frame 4 and oriented parallel to the axis of the vehicle such that the opening of the armored cover 3 and of the frame 4 equipped with the transparent cap 2 is effected laterally.

The two covers are subjected to the action of recall springs 3′ and 4′ between axle 6 and the respective cover 3 and frame 4 which urges the cover 3 and cap 2 to respective open positions.

The opening of the armored cover 3 is controlled by an actuating appartus from the interior of the observation post by means of a crank 7 and the apparatus will be described in greater detail later with regard to FIG. 11.

The degree of opening of the armored cover 3 is limited by an abutment 8, so disposed, that the armored cover, when open to a maximum degree, is in a position inclined upwardly and outwardly to laterally protect the head of the observer.

The frame 4 carries two closure latches or locks which will be more explicitly described with regard to FIGS. 5 to 10, including on the one hand, a latch 9, for automatically engaging upon closing of the cap and manually controlled to lock the frame 4 and the armored cover 3 when the latter is closed and fitted on the transparent cap 2, and on the other hand, a lock 10 also engaged automatically upon closing of the cap 2, to lock the frame 4 and the roof 1 of the vehicle when the frame is applied against the edge 5, the lock 10 being manually disengageable.

Figure 2:
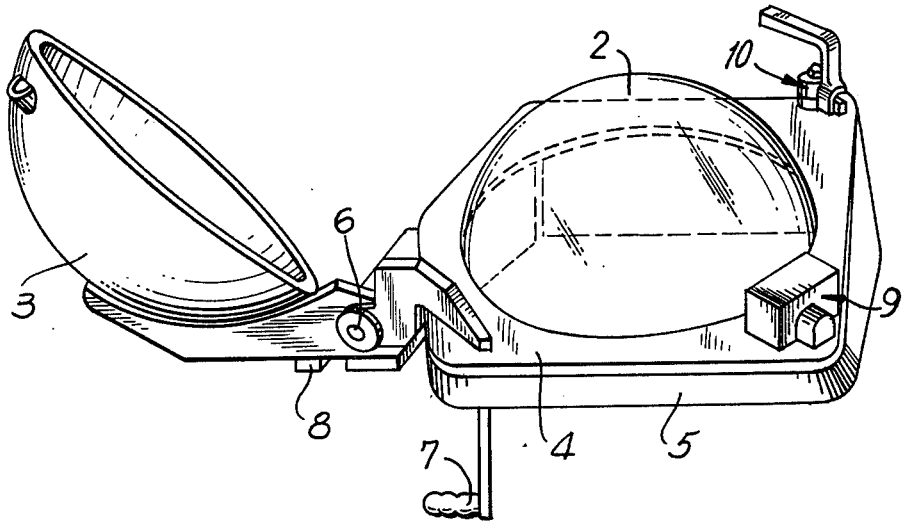
FIG. 2 is similar to FIG. 1 but with the armored cover in open position and the transparent cap in closed position.

FIG. 1 shows the cap 2 and cover 3 in closed position; FIG. 2 shows the armored cover 3 completely open and the transparent cap 2 closed; FIG. 3 shows the armored cover 3 completely open and the transparent cap 2 partially open; and FIG. 4 shows the cap 2 and cover 3 completely open, the transparent cap 2 being fitted into the armored cover 3.

There will next be described particularly simple and advantageous embodiments of the lock 9 of the armored cover 3, and the lock 10 of the transparent cap 2, and the controlling apparatus of the armored cover 3.

Referring to FIGS. 5 and 6 which show the lock 9 of the armored cover 3, it is seen that the armored cover 3 comprises a boss at its periphery which is provided with a slot 11 in which can be engaged a bolt 13 under the action of a spring 12, the bolt 13 having an inclined front face 13a permitting its automatic engagement in slot 11. The bolt 13 is slidingly mounted in a guide 14 fixed to the frame 4 carrying the transparent cap 2.

The frame 4 also carries a vertical pivotal rod 15 traversing the frame and having at its external extremity a ball-shaped finger 16 rockably engaged in a recess formed in the bolt 13 and at its internal extremity, a handle 17 by which the rod 15 can be rotated to effect disengagement of the bolt 13 against the action of its recall spring 12.

Referring to FIGS. 7 to 10, showing an embodiment of the lock 10 of the transparent cap 2, it is seen that the frame 4 carries, on its internal wall, a bracket 18 extending to the level of the roof 1 of the turret, said bracket carrying at its interior extremity, a cover 19 having spaced flanges between which is pivotingly mounted, on an axle 20, a latch 21 subjected to the action of a recall spring 22 urging the latch to a projecting position beneath roof 1.

The roof 1 carries at the interior of the turret in the region of the latch 21, a lever 23 articulated on an axle 24 and acting, when pivoted against the action of a recall spring 25, to effect disengagement of the latch 21 against the action of its spring 22.

Figure 8:
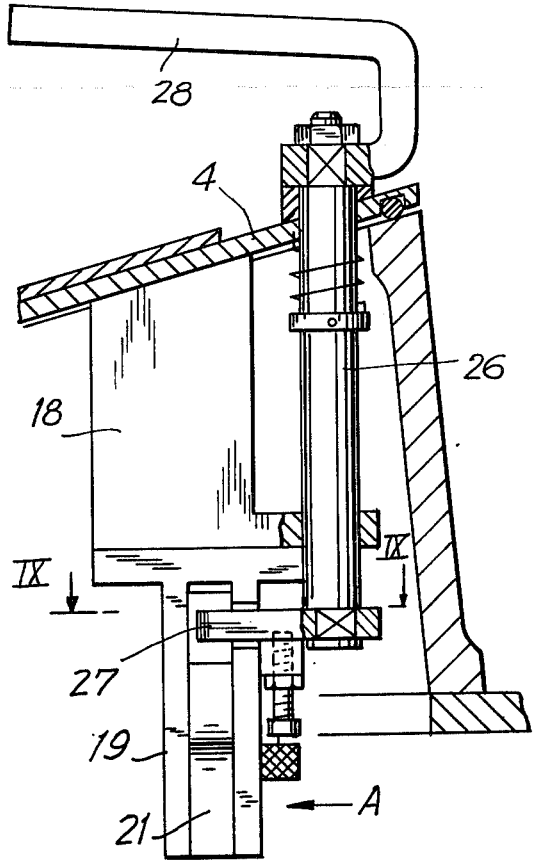
FIG. 8 is a vertical sectional view of control apparatus permitting opening from the exterior either the two covers together, or the transparent cap when the armored cover is already open.

The lock 10 advantageously comprises a means permitting its opening from the exterior comprising, as shown in FIG. 8, a vertical rod 26 pivotably mounted at the periphery of the frame 4 and traversing said frame in the region of the bracket 18. Rod 26 carries, at its internal extremity, a finger 27 situated adjacent the latch 21. At its external extremity the rod 26 carries a handle 28 for rotating the rod 26 to disengage finger 27 from the latch 21 and permit the opening of the frame 4 carrying the transparent cap 3.

Figure 9:
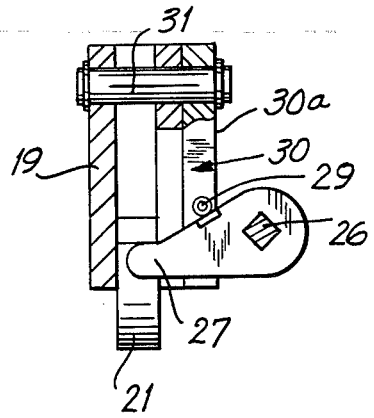
FIG. 9 is a sectional view taken along line IX — IX in FIG. 8.
Figure 10:
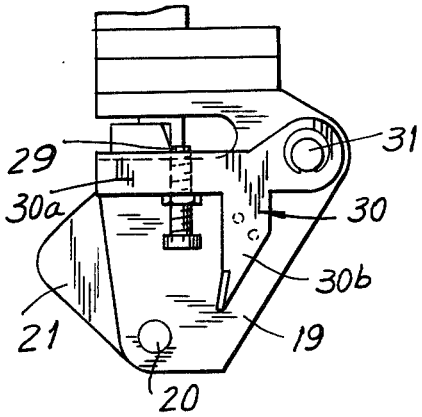
FIG. 10 is a side view, in the direction of arrow A, of a detail in FIG. 8.

Preferably, a suitable means is provided to prevent an opening operation on handle 28 in the course of military operations, such means comprising, as shown in FIGS. 9 and 10, a screw 29 carried by a leg **30*a* of a two-legged member 30 pivotably mounted on an axle 31. The two legs 30*a*, 30*b* of member 30 are at right angles to one another and leg 30*b* constitutes a control finger permitting pivotal movement around the axle 31 of the assembly of the member 30 and the screw 29, said assembly being mounted adjacent one edge of the flange 19 in such a position that the member 30 can travel from an active position (illustrated in FIGS. 9 and 10) in which the screw 29 acts as an abutment and prevents pivoting of the control finger 27 from the exterior by the action of handle 28 to a disengaged position in which the screw 29 no longer blocks pivoting of the finger 27.**

Figure 11:
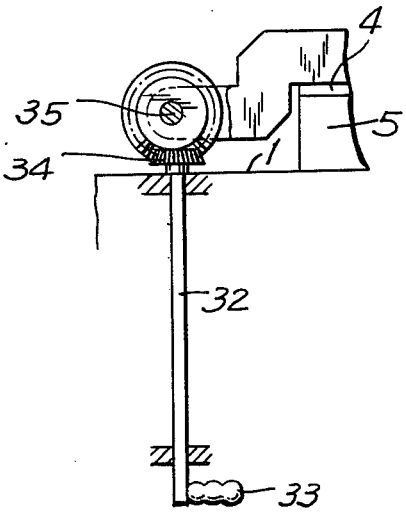
FIG. 11 diagrammatically illustrates a control apparatus for simultaneously opening the two covers or for opening the armored cover only.

FIG. 11 shows an embodiment of a positive control apparatus of the armored cover 3, said control apparatus comprising a vertical rod 32 traversing the roof 1 of the turret and carrying at its internal extremity, a control crank 33, and at its external extremity a bevel gear 34 in mesh with a conical toothed ring 35 fixed in rotation with the hub of the armored cover 3. The crank 33 in FIG. 11 corresponds to the crank 7 illustrated in FIGS. 1 to 4.

The invention is not limited in any way to the specific embodiments which have been illustrated, but in contrast contemplates all modifications and variations within the bounds of the appended claims.

What is claimed is:

1. An observation post for military equipment comprising a structure having an opening through which at least the head of an observer can pass, and a sealable enclosure for said opening including an inner rigid transparent cap fitted at said opening, a frame carrying said transparent cap, said frame being pivotably mounted on said structure and being sealable thereon so that said opening is covered, an outer armored hatch cover for covering said inner cap, means for selectively opening and closing the outer cover independently of the inner cap, and means supporting said frame of said transparent cap for pivotal movement between open and closed positions independently of said armored cover including a common axle about which said frame of said cap and said armored cover are respectively pivotable.

2. An observation post as claimed in claim 1 comprising spring means acting on said armored cover for urging the same to open position.

3. An observation post as claimed in claim 1 comprising spring means acting on said transparent cap for urging the same to open position.

4. An observation post as claimed in claim 1 wherein said cap and said cover have respective peripheries, said axle being disposed in the region of said peripheries.

5. An observation post as claimed in claim 1 comprising abutment means for limiting the degree of opening of the armored cover so that in open position it is inclined upwardly and outwardly to provide lateral protection for the head of an observer positioned within the transparent cap.

6. An observation post as claimed in claim 1 comprising a locking means carried by said armored cover for automatically locking the cover when it is closed, and means accessible from within the observation post for manually unlocking the locking means.

7. An observation post as claimed in claim 6 said locking means comprising a latch member and a recessed member positioned to receive the latch member, one of said members being carried by said armored cover, the other by said support frame.

8. An observation post as claimed in claim 1 comprising a locking means carried by said cap for automatically locking the cap when it is closed, and means accessible from within the observation post for manually unlocking the cap.

9. An observation post as claimed in claim 8 said locking means comprising a latch member and a recessed member positioned to receive the latch member, one of said members being carried by said support frame, the other by said structure.

10. An observation post as claimed in claim 8 comprising means at the exterior of the cap for manually unlocking the cap.

11. An observation post as claimed in claim 10 comprising means accessible from within the observation post for blocking operation of the means at the exterior of the cap which unlocks the cap.

12. An observation post as claimed in claim 1 wherein said cap and said hatch cover are substantially hemispherical, said common axle being disposed outside of the cap and cover and adjacent the peripheries thereof so that opening of the cap and cover is effected laterally.

13. An observation post as claimed in claim 12 wherein said cap and cover interengage in the open and closed positions.

* * * * *